United States Patent [19]

Tamary

[11] Patent Number: 4,684,784

[45] Date of Patent: Aug. 4, 1987

[54] FUSER TEMPERATURE CONTROL

[75] Inventor: Ernest J. Tamary, Rochester, N.Y.

[73] Assignee: Eastman Kodak Company, Rochester, N.Y.

[21] Appl. No.: 855,237

[22] Filed: Apr. 24, 1986

[51] Int. Cl.[4] ..... H05B 1/00; G03G 15/20

[52] U.S. Cl. ..... 219/216; 219/388; 219/469; 219/471; 355/3 FU; 355/14 FU; 432/60

[58] Field of Search ..... 355/14 FU, 3 FU; 219/216, 388, 244, 469, 471; 432/60; 271/900

[56] References Cited

U.S. PATENT DOCUMENTS

| | | | |
|---|---|---|---|
| 3,417,226 | 12/1968 | Thomiszer | 219/216 |
| 3,813,516 | 5/1974 | Kudsi et al. | 219/216 X |
| 3,888,622 | 6/1975 | Thettu | 355/3 FU |
| 4,043,747 | 8/1977 | Ogiwara | 432/60 |
| 4,080,159 | 3/1978 | Behun | 355/3 FU |
| 4,144,835 | 3/1979 | Fukase et al. | 219/216 X |
| 4,197,445 | 4/1980 | Moser | 219/216 |
| 4,332,457 | 6/1982 | Mitsuyama et al. | 355/3 FU |
| 4,367,037 | 1/1983 | Nishikawa | 355/14 FU |
| 4,391,509 | 7/1983 | Cavagnaro | 355/14 FU |
| 4,421,401 | 12/1983 | Kagiura et al. | 355/3 FU |
| 4,487,158 | 12/1984 | Kayson | 355/3 FU |
| 4,512,649 | 4/1985 | Derimiggio | 355/14 FU |
| 4,541,708 | 9/1985 | Shigenobu | 355/14 FU |
| 4,568,275 | 2/1986 | Sakurai | 219/216 X |
| 4,585,325 | 4/1986 | Euler | 355/14 FU |
| 4,616,917 | 10/1986 | Sakurai | 355/3 FU |
| 4,634,262 | 1/1987 | Imaizumi et al. | 355/14 FU |
| 4,642,448 | 2/1987 | Shigemura et al. | 355/3 FU |

OTHER PUBLICATIONS

Research Disclosure Publication No. 19642, Research Disclosure Aug. 1980, Disclosed by F. A. Booth and M. G. Reid, pp. 338-339.

*Primary Examiner*—R. L. Moses

*Attorney, Agent, or Firm*—Milton S. Sales

[57] ABSTRACT

Apparatus is disclosed for feeding a support web between a pair of fusing rollers, at least one of which is heated. Heat conductive skive means is supported in contact with the heated roller for stripping the web material from the roller. Temperature sensitive means in heat-conducting contact with the skive means senses the temperature change of the roller by conduction along the skive means. The temperature sensitive means generates an electrical signal representative of the temperature change, and the signal is coupled to temperature control means operative in response to the generated signal to control the temperature of the heated roller so that the temperature transferred to the web material is maintained within preferred temperature limits.

4 Claims, 2 Drawing Figures

FUSER TEMPERATURE CONTROL

BACKGROUND OF THE INVENTION

2. Field of the Invention

This invention relates generally to apparatus for fusing toner images to copy sheets and more particularly to such apparatus including means for controlling the surface temperature of a heated pressure roller.

2. Description of the Prior Art

Electrographically reproduced copies generally comprise toner images of an original document, the toner images being permanently affixed to copy sheets by well known fusing techniques. One such technique consists of passing a copy sheet having toner images on one or both sides thereof through the nip of a pair of fuser rollers, one or both of which are heated to permanently fuse the toner image or images to the copy sheet through the application of heat and pressure. Generally the source for heating one or both of the fuser rollers comprise quartz lamps inserted inside the fuser rollers or a heating element which applies heat to the external surface of the rollers.

The fusing temperature should be maintained within preferred temperature limits dependent, for example, upon the type of toner to be fused, the characteristics of the fuser rollers, and the characteristics of the copy sheet material. Sensors are used to monitor the heat level of the fuser rollers in order to maintain the temperature within predetermined limits and to signal overheating so that the fuser roller may be shut down.

Skive means are supported in contact with the fuser roller at or near to the roller nip exit to assist in stripping copy sheets from the fuser rollers.

There are several prior art systems for providing heat transfer from the roller to the temperature sensor. In U.S. Pat. No. 4,043,747, which issued Aug. 23, 1977 to M. Ogiwara, a temperature detector for controlling a heating element rides against the surface of a heated fusing roller to directly measure the temperature of the roller surface. However, over a long time period, the surface of the heated roller is subject to abrasion from the detector, and the detector is subject to wear from the roller. If abraded, the roller is less likely to produce homogeneous fixing of the toner particles. To more evenly distribute the wear on the roller, the patent teaches moving the detector axially along the surface of the roller.

Non-contact temperature sensors overcome the abrasion problem of the previously mentioned prior art systems. Such non-contact sensors may be infrared temperature detectors which require complex electronics and increase the cost of the system. Another non-contact sensor is a thermocouple-type mounted within the thermal boundary layer adjacent the heated roller for sensing the temperature change of the air within the boundary layer and for generating an electrical signal varying in accordance with the temperature changes. However, such electrical signal is highly sensitive to changes in the spacing of the detector from the roller and to ambient temperature changes.

Another type of temperature sensing means known in the prior art is shown in an article (No. 19642) entitled "Temperature Control of Fuser Roller", published in *Research Disclosure,* August, 1980, pages 338 and 339. A thermistor is embedded in a graphite block which rides in contact with the heat conductive core of a fuser roller. The temperature sensed by the assembly produces an electrical signal to control the heat of the roller. Such systems which measure the temperature of the core are considered to be less accurate and to have longer time constants (unacceptable time lag in temperature controlling characteristics) than systems which directly measure the surface temperature of the roller.

In reviewing the above, it is recognized that temperature sensors which directly contact the surface of the roller are regarded as being the most accurate and least expensive of the known systems, but with the disadvantage of subjecting the roller surface to adverse abrasion. It is therefore a primary object of the invention to provide a temperature sensing system with the advantages of a contact sensor but which will not increase roller wear.

SUMMARY OF INVENTION

In accordance with the present invention, there is provided an apparatus for feeding a support web between a pair of fusing rollers, at least one of which is heated. Heat conductive skive means is supported in contact with the heated roller for stripping the web material from the roller. Temperature sensitive means in heat-conducting contact with the skive means senses the temperature change of the roller by conduction along the skive means. The temperature sensitive means generates an electrical signal representative of the temperature change, and the signal is coupled to temperature control means operative in response to the generated signal to control the temperature of the heated roller so that the temperature transferred to the web material is maintained within preferred temperature limits.

Apparatus in accordance with the invention will not contribute to the wear of the surface of the roller since the skive means is necessary whether or not the temperature sensing and control means are used, and the presence of the temperature sensing means in heat-conducting contact with the skive means does not add to the wear to the surface of the roller from the skive means.

The invention, and its objects and advantages, will become more apparent in the detailed description of the preferred embodiment presented below.

BRIEF DESCRIPTION OF THE DRAWINGS

In the detailed description of the preferred embodiment of the invention presented below, references made to the accompanying drawings in which.

DESCRIPTION OF THE PREFERRED EMBODIMENT

Figure 1:
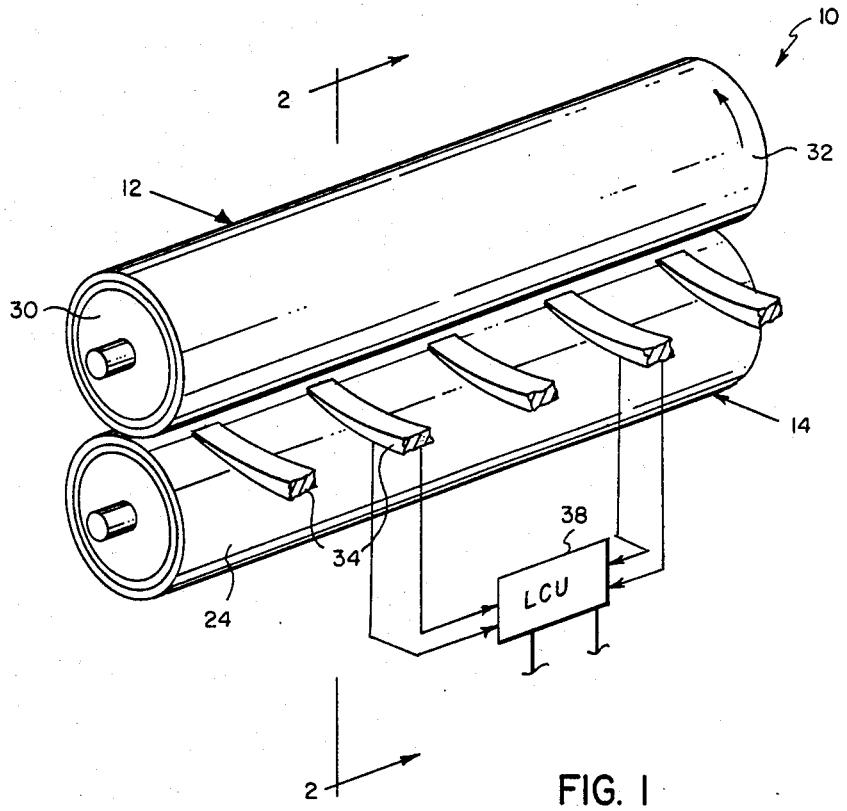
FIG. 1 is a perspective view of apparatus for fusing toner images in accordance with the present inventions.
Figure 2:
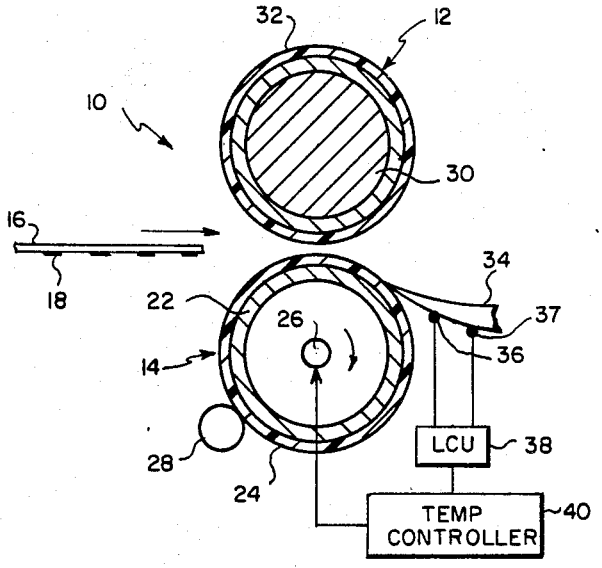
FIG. 2 is a cross section view along line 2—2 in FIG. 1.

Referring now to the drawings, there is shown fuser apparatus according to the present invention. The fuser apparatus may be used in an electrographic copier in which a toner image of an original is formed on a reusable photoconductive member and is subsequently transferred to a support web, such as a copy sheet, to be fused by the fuser apparatus to produce a permanent copy. Because copiers are well known, the present description will be directed, in particular, to elements forming part of, or cooperating more directly with, apparatus in accordance with the present invention. It is to be understood that copier elements not specifically shown or described may take various forms well known to those skilled in the art. However, an exemplary copier capable of producing simplex or duplex copies is disclosed in commonly assigned U.S. Pat. No. 4,391,509, which issued on July 5, 1985 to W. A. Cavagnaro, the disclosure of which is incorporated herein by reference.

Fuser apparatus 10 includes an upper roller 12 and a lower roller 14 which form a nip through which a copy sheet 16 carrying a toner image 18 is passed. Roller 14 includes a cylindrical core 22 of heat conductive material such as aluminum and a fusing layer 24 of temperature resistant material having good release properties, such as silicone elastomer. Mounted internally of roller 14 is a heater element 26 such as a quartz lamp. An applicator roller 28 is provided to apply release material such as silicone oil to the surface of roller 14 to increase its release characteristics.

Roller 12 may be of the same construction as roller 14 if duplex copies are fused, or, as shown, may comprise a pressure roller having an aluminum core 30 with a polytetrafluoroethylene coating 32 for backing up roller 14.

Image-bearing copy sheet 16 tends to remain in contact with the surface of heated pressure roller 14 as the copy sheet passes through the nip of the fuser apparatus. Accordingly, means are provided to effect the removal of the copy sheet from the roller surface after fusing is accomplished. To this end, it is common to provide skive means such as one or more pickoff fingers 34 mounted slightly downstream from the nip of the fuser apparatus. The fingers ride lightly upon the roller surface and are arranged to enter between the roller surface and the copy sheet as the copy sheet leaves the fuser apparatus nip. Thusly, the fingers redirect the copy sheet along a predetermined path to travel away from the roller.

Although there is some risk of abrasion of the surface of the roller by the fingers of the skive means, the pressure is kept light and the surface of the fingers are smooth to minimize such risk. While the present invention does nothing to reduce the risk of surface abrasion by the fingers, it provides for a means to sense the temperature change of roller 14 by means of heat conduction between the roller to a temperature sensor without increasing the risk of roller surface abrasion.

To this and, a temperature sensitive means are mounted on at least one of pickoff fingers 34. The temperature sensitive means include a pair of sensors 36 and 37 in heat-conducting contact with a finger. Sensors 36 and 37 may be thermistors, and produce signals representative of the temperatures sensed. A temperature control means includes a logic and control unit (LCU) 38 and a temperature controller 40 are provided to utilize the temperature signals produced by sensors 36 and 37. A suitable LCU which may be used in the present apparatus is shown and described in commonly assigned U.S. Pat. Nos. 4,095,979 and 4,174,905. Another suitable LCU for used in a simplex copier is shown in commonly assigned U.S. Pat. No. 3,914,047.

Response to sensors 36 and 37 can be characterized by the following two equations:

$$\frac{T_{36} - T_{37}}{T_R} = f[e^{-(t/\tau 37)}] \quad (1)$$

-continued $$\frac{T_{36}}{T_R} = g[e^{-(t/\tau 36)}] \quad (2)$$

where "T" is the sensor temperature; t is the time since the roller changed temperature; $\tau$ is the time constant of the roller/skive/sensor combination; and subscripts 36, 37, and R refer to sensor 36, sensor 37 and roller 24, respectively. Combining equations (1) and (2), $$T_R = k\left[\frac{(T_{36} - T_{37})^{\alpha}}{(T_{36})^{\beta}}\right]^{1/(\alpha - \beta)}$$

The values of k, $\alpha$, $\beta$ can be calibrated experimentally, and $T_R$ independently of the time since the roller temperature underwent a change.

LCU 38 controls the amount of energy supplied from temperature controller 40 (see, e.g., the controllers disclosed in U.S. Pat. No. 4,046,990 and Research Disclosure publication No. 19642) to heater element 26 in response to the temperature signal provided from sensor 36.

The invention has been described in detail with particular reference to preferred embodiments thereof. However, it will be understood that variations and modifications may be effected within the spirit and scope of the invention.

What is claimed is:

1. In fuser apparatus of the type having at least one heated fuser roller for fusing toner images on support web, skive means a supported in contact with the roller for stripping a support web from the roller; the improvement wherein the skive means is heat conductive and said fuser apparatus further comprises:

temperature sensitive means in heat-conducting contact with said skive means (1) for sensing the temperature change of the roller by heat conduction along said skive means and (2) for generating an electrical signal representative of said temperature change; and temperature control means responsive to said generated electrical signal from said temperature sensing means to maintain the temperature of the surface of said fuser roller within predetermined limits so that the toner is completely fused to the support web as the web is fed through said fuser apparatus.

2. The improvement as defined in claim 1 wherein:

said skive means comprises a plurality of pickoff fingers spaced axially along the fuser roller; and said temperature sensitive means comprises a pair of sensors on at least two of said fingers..

3. The improvement as defined in claim 1 wherein said temperature controller comprises:

a temperature controller for the fuser roller;

a logic control unit for controlling the amount of energy supplied from said temperature controller to the heated fuser roller in response to the generated electrical signal from said temperature sensing means.

4. In an electrographic copier having fuser apparatus of the type having at least one heated pressure roller for fusing toner images on copy sheets, skive means supported in contact with the roller for stripping copy sheets from the roller; the improvement wherein the skive means is heat conductive and the fuser apparatus further comprises;

temperature sensitive means in heat-conducting contact with said skive means (1) for sensing the temperature change of the roller by heat conduction along said skive means and (2) for generating an electrical signal representative of said temperature change;

temperature control means responsive to said generated electrical signal from said temperature sensing means to maintain the temperature of the surface of said fuser roller within predetermined limits so that the toner is completely fused to the copy sheets as the sheets are fed through the fuser apparatus.

* * * * *